US007104322B2

(12) United States Patent
Whanger et al.

(10) Patent No.: US 7,104,322 B2
(45) Date of Patent: Sep. 12, 2006

(54) OPEN HOLE ANCHOR AND ASSOCIATED METHOD

(75) Inventors: Ken Whanger, Houston, TX (US); Simon Harrall, Inverurie (GB); Christopher Cuffe, The Woodlands, TX (US); Robert Badrak, Sugarland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/442,690

(22) Filed: May 20, 2003

(65) Prior Publication Data

US 2004/0231860 A1 Nov. 25, 2004

(51) Int. Cl.
*E21B 43/10* (2006.01)
*E21B 29/00* (2006.01)

(52) U.S. Cl. ..... 166/277; 166/380; 166/207; 166/181; 166/120; 166/123

(58) Field of Classification Search ..... 166/207, 166/195, 277, 380, 297, 187, 120, 123, 181
See application file for complete search history.

(56) References Cited

U.S. PATENT DOCUMENTS

| | | | | |
|---|---|---|---|---|
| 2,096,234 A | | 10/1937 | Erwin | |
| 3,186,485 A | | 6/1965 | Owen | 166/63 |
| 3,326,293 A | * | 6/1967 | Skipper | 166/150 |
| 3,353,599 A | | 11/1967 | Swift | |
| 3,412,565 A | | 11/1968 | Lindsey et al. | |
| 3,477,506 A | * | 11/1969 | Malone | 166/207 |
| 3,529,667 A | | 9/1970 | Malone | |
| 3,712,376 A | | 1/1973 | Owen et al. | 166/277 |
| 3,746,091 A | | 7/1973 | Owen et al. | 166/207 |
| 3,948,321 A | | 4/1976 | Owen et al. | 166/277 |
| 3,986,383 A | | 10/1976 | Petteys | |
| 4,580,426 A | | 4/1986 | Zafred | |

(Continued)

FOREIGN PATENT DOCUMENTS

| | | |
|---|---|---|
| FR | 1142975 | 9/1957 |
| GB | 2 344 606 | 6/2000 |
| WO | WO 97/06346 | 2/1997 |
| WO | WO 99/23354 | 5/1999 |
| WO | WO 00/58601 | 10/2000 |
| WO | WO 01/18354 | 3/2001 |
| WO | WO 03/015954 | 2/2003 |
| WO | WO 03/074838 | 9/2003 |

OTHER PUBLICATIONS

International Search Report, Based on PCT/GB02/03734, Dated Nov. 15, 2002.
International Preliminary Examination Report, Based on PCT/GB02/03734, Dated Sep. 3, 2003.
U.K. Search Report, Application No. GB 0411127.4, dated Aug. 11, 2004.

*Primary Examiner*—David Bagnell
*Assistant Examiner*—Shane Bomar
(74) *Attorney, Agent, or Firm*—Patterson & Sheridan

(57) ABSTRACT

The present invention relates to a method and apparatus for anchoring an expandable tubular within a wellbore prior to expanding the length of the expandable tubular into contact with the wellbore. An expandable system comprises the expandable tubular and a deployment tool, wherein the deployment tool exerts radial force against the expandable tubular to expand at least a portion of the expandable tubular into contact with the wellbore to anchor the expandable tubular prior to the expansion process. A method for anchoring an expandable tubular within a wellbore prior to the expansion process is also provided, wherein radial force expands the expandable tubular into contact with the wellbore to initially anchor the expandable tubular. A method for altering the shape of the anchor is also provided.

52 Claims, 14 Drawing Sheets

U.S. PATENT DOCUMENTS 5,027,894 A 7/1991 Coone et al.
5,220,959 A 6/1993 Vance, Sr.
5,297,633 A 3/1994 Snider et al.
5,695,008 A 12/1997 Bertet et al.
5,833,001 A 11/1998 Song et al.
6,085,838 A 7/2000 Vercaemer et al.
6,253,850 B1 7/2001 Nazzai et al.
6,321,847 B1 11/2001 Brown
6,425,444 B1 7/2002 Metcalfe et al.
6,454,013 B1 9/2002 Metcalfe
6,488,095 B1 * 12/2002 Buytaert ..... 166/382
6,640,893 B1 11/2003 Rummel et al.
6,648,071 B1 * 11/2003 Hackworth et al. ..... 166/207
6,719,064 B1 * 4/2004 Price-Smith et al. ..... 166/387
6,742,598 B1 6/2004 Whitelaw et al.
2002/0189696 A1 12/2002 Simpson et al. ..... 138/89
2003/0121558 A1 * 7/2003 Cook et al. ..... 138/98
2003/0178197 A1 * 9/2003 Smith et al. ..... 166/313
2003/0183395 A1 10/2003 Jones
2004/0020659 A1 * 2/2004 Hall et al. ..... 166/380
2004/0055758 A1 * 3/2004 Brezinski et al. ..... 166/384
2004/0065445 A1 * 4/2004 Abercrombie Simpson et al. ..... 166/382
2004/0118572 A1 6/2004 Whanger et al.

* cited by examiner

OPEN HOLE ANCHOR AND ASSOCIATED METHOD

BACKGROUND OF THE INVENTION

1 . Field of the Invention

The present invention generally relates to a downhole tool for use in a wellbore. More particularly, the invention relates to isolating an area of interest within a wellbore. More particularly still, the invention relates to anchoring an expandable tubular within the wellbore prior to isolating the wellbore.

2 . Description of the Related Art

In the drilling of oil and gas wells, a wellbore is formed using a drill bit that is urged downwardly at a lower end of a drill string. After drilling a predetermined depth, the drill string and bit are removed, and the wellbore is typically lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

Generally, it is desirable to provide a flow path for hydrocarbons from the surrounding formation into the newly formed wellbore. Typically, perforations are formed in the casing or in the open hole portion of the wellbore at the anticipated depth of hydrocarbons. The perforations are strategically formed adjacent the hydrocarbon zones to limit the production of water from water rich zones that may be close to the hydrocarbon rich zones. However, a problem arises in a cased wellbore when the cement does not adhere to the wellbore properly to provide an effective fluid seal. The ineffective seal allows water to travel along the cement and wellbore interface to the hydrocarbon rich zone. As a result, water or gas may be produced along with the hydrocarbons.

One attempt to solve this problem is to employ a downhole packer, commonly an inflatable packer, to isolate specific portions of the wellbore. The downhole packer may be installed as an open-hole completion to isolate a portion of the wellbore and eliminate the need of cementing the annular area between the casing and the wellbore of the isolated portion. Typically, the downhole packer may be formed as an integral member of the existing casing and installed adjacent the desired production zone.

More recently, expandable tubular technology has been applied to downhole packers. Generally, expandable technology enables a smaller diameter tubular to pass through a larger diameter tubular, and thereafter expanded to a larger diameter. In this respect, expandable technology permits the formation of a tubular string having a substantially constant inner diameter. Accordingly, an expandable packer may be lowered into the wellbore and expanded into contact with the wellbore. By adopting the expandable technology, the expandable packer allows a larger diameter production tubing to be used because the conventional packer mandrel and valving system are no longer necessary.

When an expandable tubular is run into a wellbore, it must be anchored within the wellbore at the desired depth to prevent rotation of the expandable tubular during the expansion process. Anchoring the expandable tubular within the wellbore allows expansion of the length of the expandable tubular into the wellbore by an expander tool. The anchor must provide adequate frictional engagement between the expandable tubular and the inner diameter of the wellbore to stabilize the expandable tubular against rotational and longitudinal axial movement within the wellbore during the expansion process.

The expandable tubular used to isolate the area of interest is often run into the wellbore after previous strings of casing are already set within the wellbore. The expandable tubular for isolating the area of interest must be run through the inner diameter of the previous strings of casing to reach the portion of the open hole wellbore slated for isolation, which is located below the previously set strings of casing. Accordingly, the outer diameter of the anchor and the expandable tubular must be smaller than all previous casing strings lining the wellbore in order to run through the liner to the depth at which the open hole wellbore exists.

Additionally, once the expandable tubular reaches the open hole portion of the wellbore below the casing liner, the inner diameter of the open hole portion of the wellbore is often larger than the inner diameter of the casing liner. To hold the expandable tubular in place within the open hole portion of the wellbore before initiating the expansion process, the anchor must have a large enough outer diameter to sufficiently fix the expandable tubular at a position within the open hole wellbore before the expansion process begins.

There is a need for an anchor to support an expandable tubular used to isolate an area of interest within a wellbore prior to initiating and during the expansion of the expandable tubular. There is a need for an anchor which is small enough to run through the previous casing liner in the wellbore, capable of expanding to a large enough diameter to frictionally engage the inner diameter of the open hole wellbore below the casing liner, and capable of holding the expandable tubular in position axially and rotationally during the expansion of the length of the expandable tubular.

SUMMARY OF THE INVENTION

The present invention generally relates to an expandable system for anchoring an expandable tubular within a wellbore, where the expandable tubular is used to isolate an area of interest within the wellbore. The expandable system comprises an expandable tubular with packing elements disposed thereon for isolating an area of interest within the wellbore. The expandable system is initially anchored within the wellbore by radial force exerted on the expandable tubular before further expansion of the expandable tubular along its length.

In one aspect, the expandable system includes an expandable tubular and a deployment system. The deployment system includes a tubular having a bore therethrough with one or more packers disposed around the tubular. The one or more packers are used to exert radial force against the expandable tubular to anchor the expandable tubular within the wellbore.

The present invention further relates to a method of using the expandable system. The expandable tubular and the deployment system are temporarily connected during run-in of the expandable system. The one or more packers are deployed and actuated to deform at least a portion of the expandable tubular into frictional contact with the wellbore, thus preventing the expandable system from longitudinal axial or rotational movement within the wellbore. After anchoring the expandable tubular within the wellbore, the connection between the expandable tubular and the deployment system is released. The deployment system is then removed from the wellbore, and an expander tool is employed to expand the remainder of the length of the expandable tubular into the wellbore.

Another aspect of the present invention involves an expandable system which includes an expandable tubular and a deployment system. The deployment system includes a tubular having a bore therethrough with one or more packers disposed therearound. Also connected to the tubular is an expander tool. The one or more packers are again used to exert radial force against the expandable tubular so that the expandable tubular is anchored within the wellbore.

In use, the expandable tubular is temporarily connected to the tubular during run-in of the expandable system. After the expandable system is run into the desired depth at which to anchor the expandable system, the one or more packers are actuated to deform at least a portion of the expandable tubular into frictional contact with the wellbore, anchoring the expandable system axially and rotationally. The temporary connection is released so that the expander tool may move axially and/or rotationally within the wellbore to expand the remaining length of the expandable tubular into contact with the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
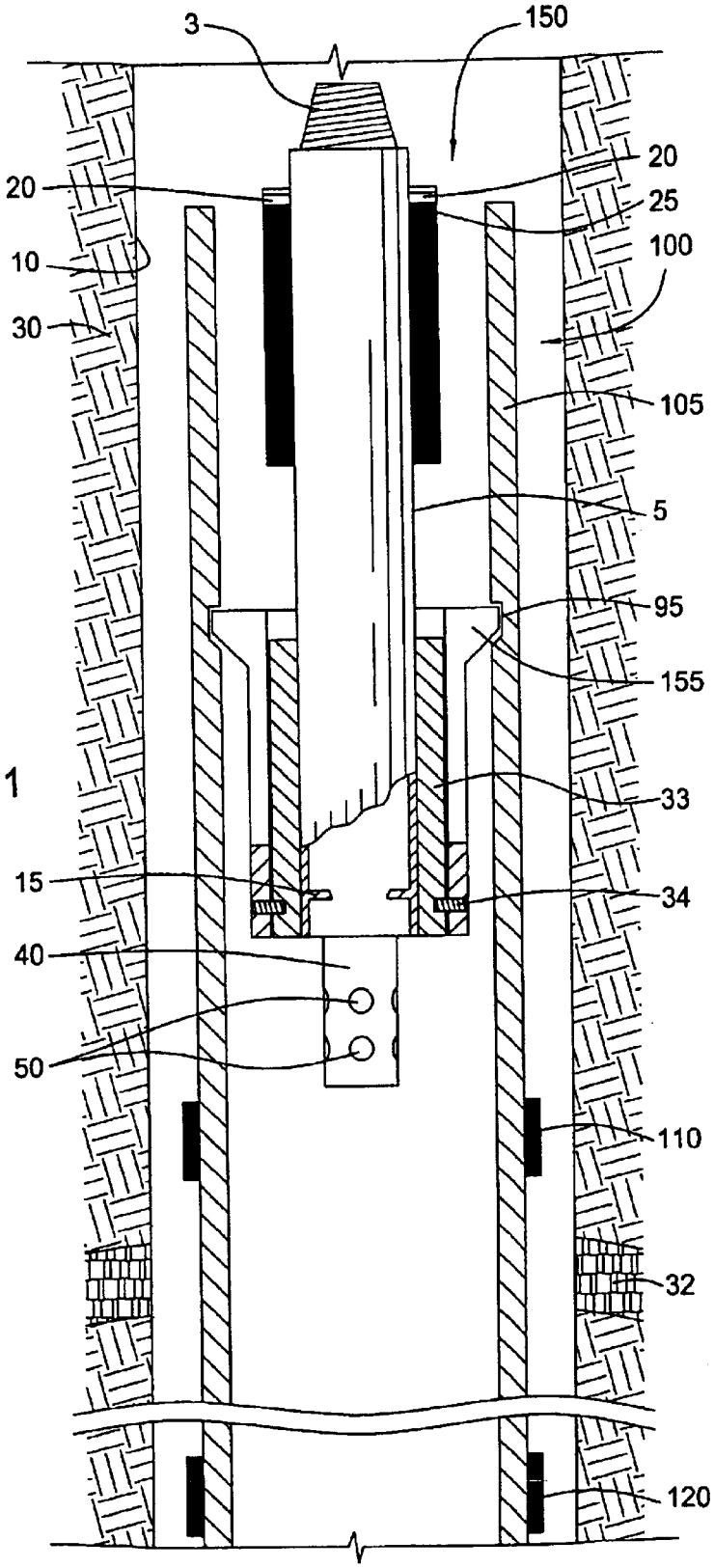
FIG. 1 is a cross-sectional view of an embodiment of an expandable system of the present invention, comprising a packer disposed on a tubular, an expandable tubular, and a collet which connects the expandable tubular to the tubular. The expandable system is shown in a wellbore in the run-in position.

FIG. 1 shows an expandable system 100 run into an open hole wellbore 10 in the run-in configuration. Aspects of the present invention are not limited to application to an open hole wellbore, but are equally applicable to a cased wellbore or tubular, as well as to horizontal or deviated wellbores. The present invention may be used to shut off production from a formation 30 as well as prevent loss of fluid in the wellbore 10 to the formation 30, along with other purposes for which isolation of an area of interest in a wellbore is productive. The expandable system 100 comprises an expandable tubular 105 and a deployment system 150. The expandable tubular 105 has an upper packer 110 and a lower packer 120 attached thereto which isolate an area of interest in the formation 30 of the wellbore 10. Exemplary expandable packers 110 and 120 which are effective in sealing the annular area between the expanded packer and the wellbore 10, thus isolating the production zone within the wellbore 10, are described in co-pending U.S. patent application Ser. No. 10/328,708 entitled "Expandable Sealing Apparatus" and filed on Dec. 23, 2002, which is herein incorporated by reference in its entirety.

The deployment system 150 comprises a packer 25 disposed on the outer diameter of a tubular 5 having a longitudinal bore therethrough. The tubular 5 is connected at its pin end 3 to a lower end of a working string (not shown), which is used to lower the expandable system 100 into the wellbore 10 from the surface. Alternatively, if the tubular 5 has a box end (not shown) at its upper end, the box end may be connected to the working string (not shown). Any other type of connection between the tubular 5 and the working string is contemplated with the present invention. The working string may provide hydraulic fluid from the surface of the wellbore 10 to the tubular 5, which supplies fluid to various components disposed on the tubular 5.

The deployment system 150 also has a collet including collet fingers 155 releasably connected at releasable connection 34 to a sleeve 33 disposed within the collet fingers 155. The sleeve 33 is disposed on the outer diameter of the tubular 5 below the packer 25, and the collet fingers 155 are located around the sleeve 33. The collet fingers 155 connect the expandable tubular 105 to the deployment tool 150 upon run-in of the expandable system 100 into the wellbore 10 by engaging a groove 95 in the expandable tubular 105.

The deployment tool 150 further includes a ball retaining assembly 15. The ball retaining assembly 15 comprises two shearable members which are connected to the inner diameter of the tubular 5 and face one another within the tubular 5. Another part of the deployment tool 150 is a ball catcher 40 disposed on the tubular 5 below the ball retaining assembly 15 and connected to the ball retaining assembly 15. The ball catcher 40 is a tubular-shaped body with holes 50 therein which allow fluid communication from the inner diameter of the tubular 5 into the wellbore 10.

The packer 25 is preferably inflatable, and more preferably an inflatable rubber element that is approximately 10 feet long. While inflatable packers are preferred for use with the present invention, other types of packers known by those skilled in the art may also be utilized. The packer 25 is secured to the outer diameter of the tubular 5. At least one valve 20 disposed on the tubular 5 allows fluid communication between the inner diameter of the tubular 5 and the inside of the packer 25. The shape of the packer 25 may vary based upon the shape of an anchor portion 107, an expanded portion of the expandable tubular 105, which is desired or necessary to create an effective anchor for the expandable system 100 within the wellbore 10. Altematively, the extent of the outer diameter of the packer 25 may be altered. The shape and outer diameter of the packer 25 directly affect the expanded anchor portion 107 of the expandable tubular 105, so that the anchor portion 107 of the expandable tubular 105 expands to become an impression of the inflated packer 25 in shape and diameter. Thus, the holding power and shape of the anchor portion 107 of the expandable tubular 105 may be directly manipulated by altering the characteristics of the packer 25 such as the shape and wall thickness of the packer 25.

Although FIGS. 1–8 depict the expandable tubular 105 as a continuous tubular body, the expandable tubular 105 may include one or more expandable tubular sections connected end to end. For example, the expandable tubular 105 may comprise three expandable tubular sections threadedly connected together, including one section which has the packers 110 and 120 disposed around its outer diameter, one section which has the groove 95 for placement of the collet fingers 155 therein, and one section which comprises the anchor portion 107. These three sections may be threaded together and arranged in any order, depending upon the application desired and the location of the anchor portion 107 desired. The sectional arrangement is advantageous because the different portions may be treated in different ways or may be different types of tubulars, as described below.

Figure 9:
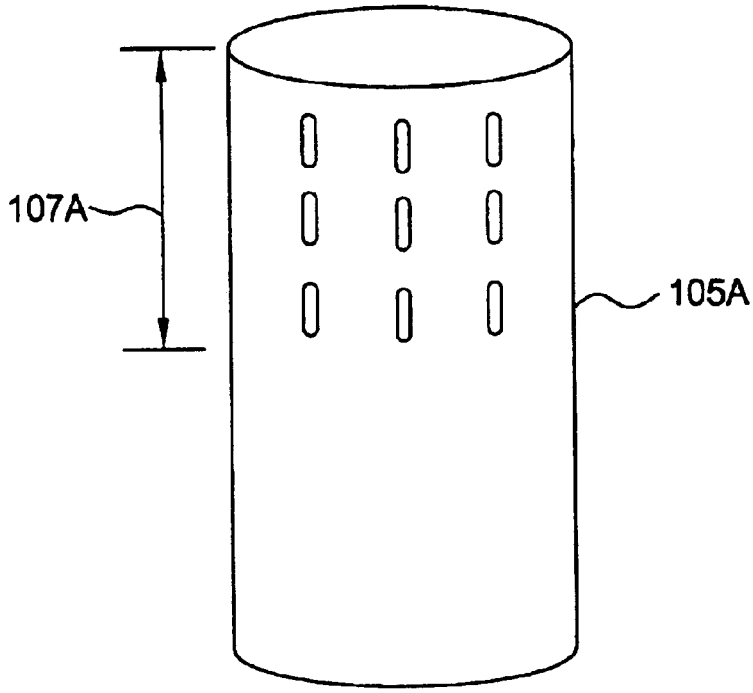
FIG. 9 shows combined slotted and solid expandable tubular.
Figure 10:
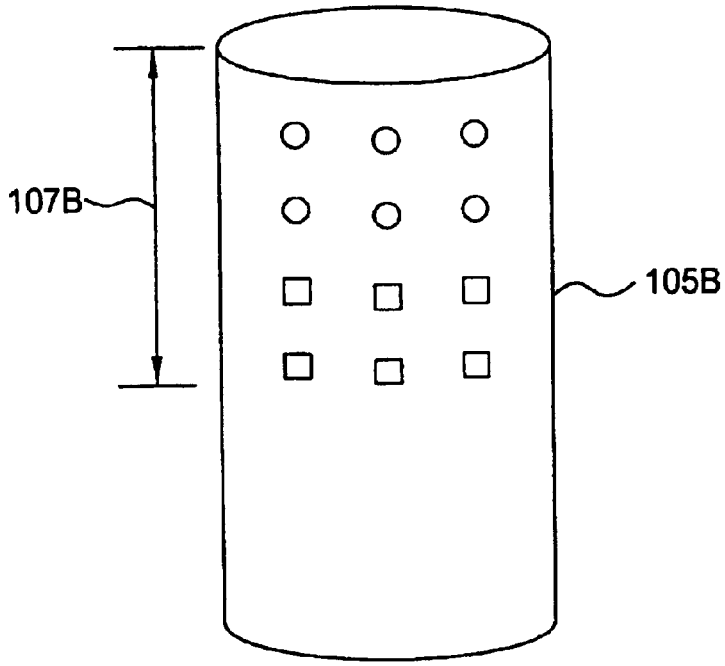
FIG. 10 shows expandable perforated pipe having different-shaped perforations. The expandable tubular is combined perforated and solid pipe.
Figure 12:
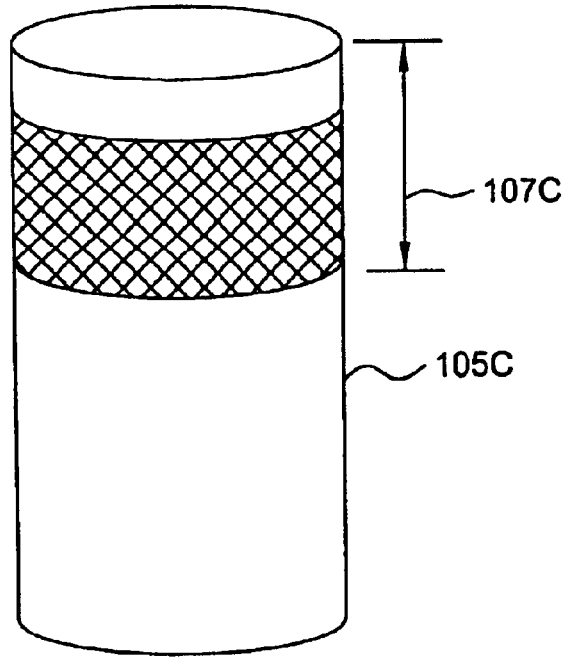
FIG. 12 shows knurling and roughening of the outer diameter of the expandable tubular.
Figure 11:
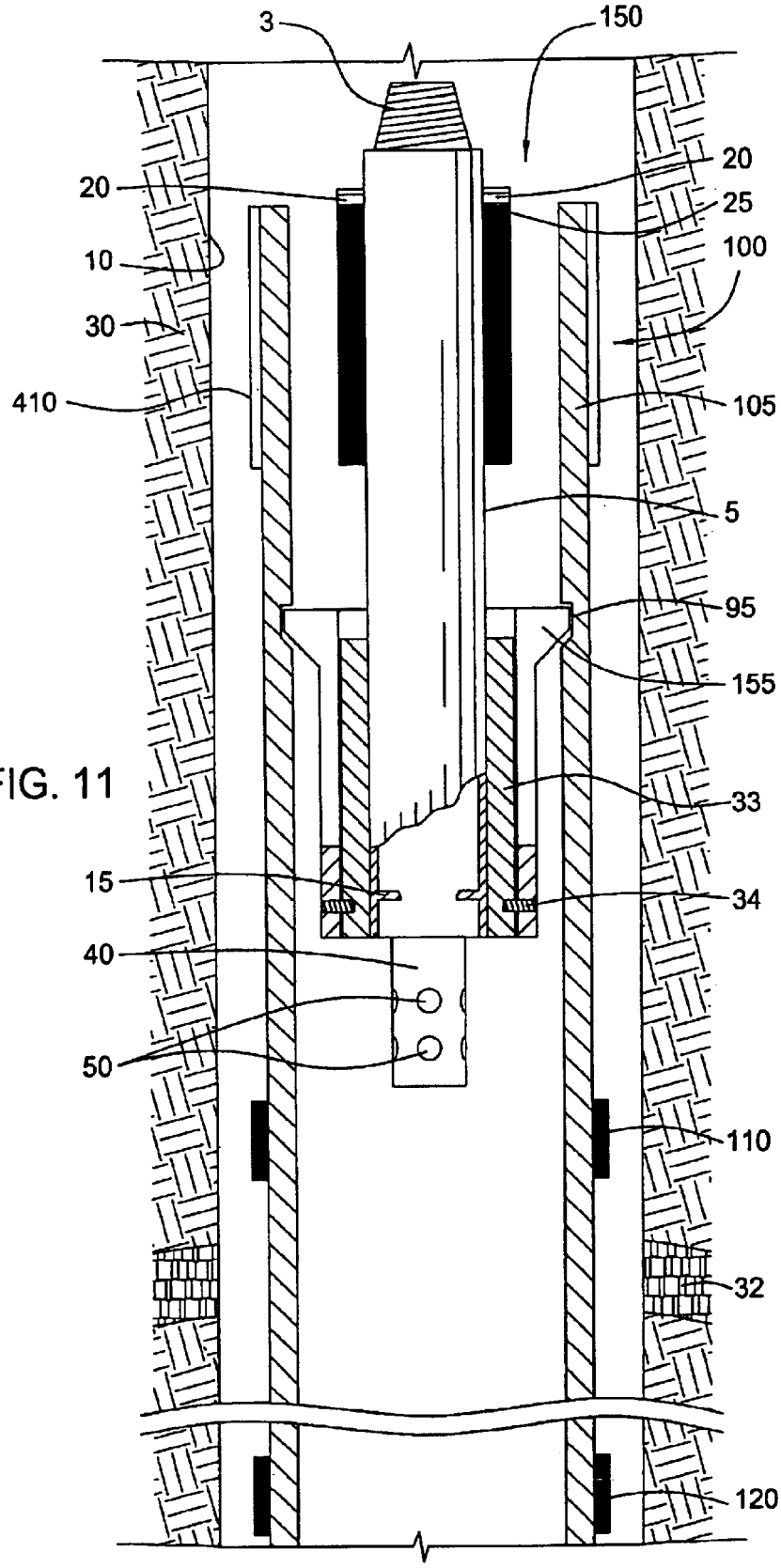
FIG. 11 shows rubber material disposed on the outer diameter of the expanded portion of the expandable tubular of FIG. 1.
Figure 13:
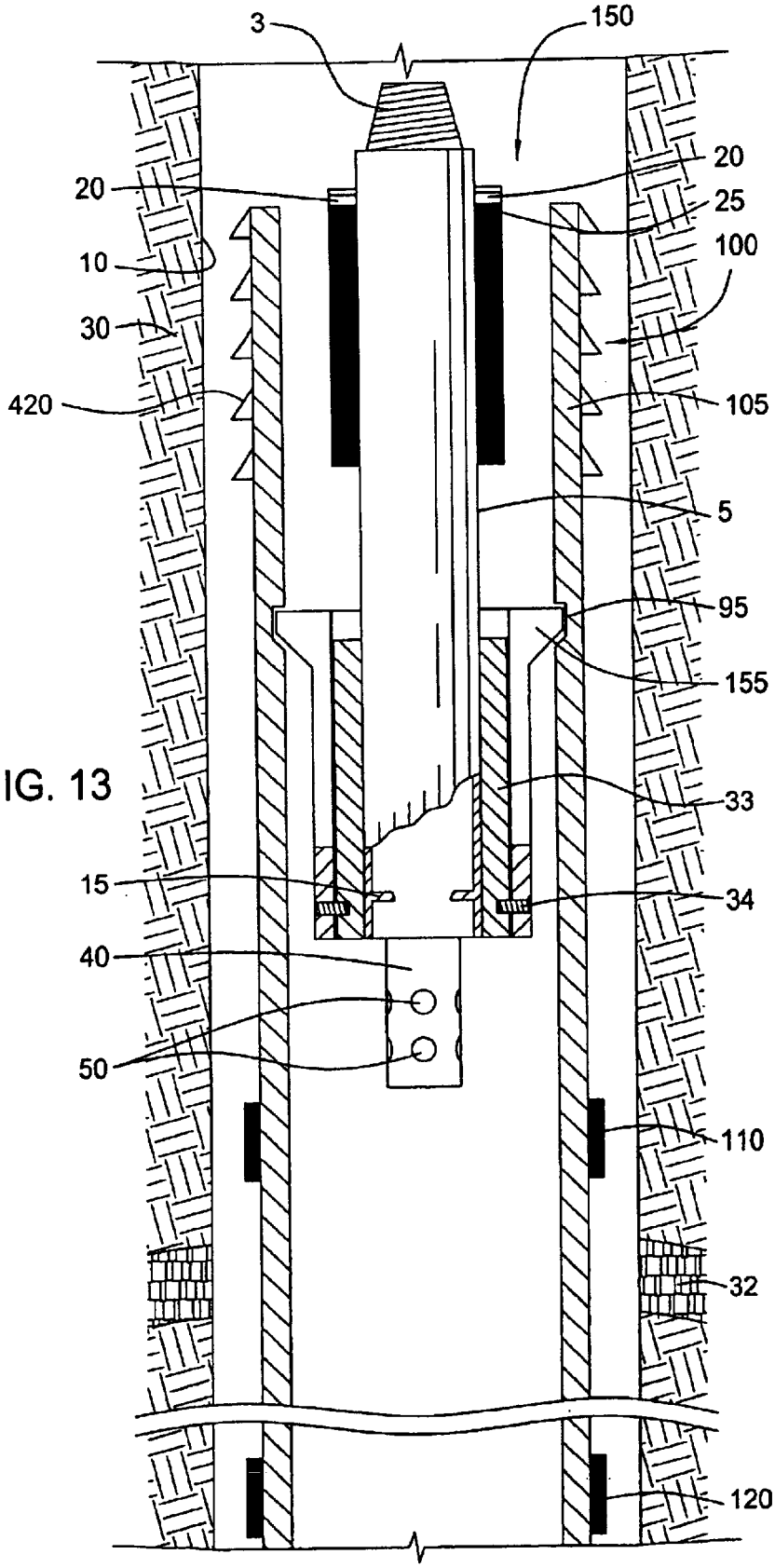
FIG. 13 shows spikes disposed on the outer diameter of the expandable tubular of FIG. 1.

At least a portion of the expandable tubular 105 may be a solid tubular-shaped body, a slotted tubular-shaped body (see FIG. 9), a perforated tubular-shaped body (see FIG. 10), an expandable screen, or any other form of an expandable tubular known to, person skilled in the art, as well as combinations of the above. Preferably, as shown in FIG. 9, the expandable tubular 105 is a tubular-shaped body with slots machined into at least the anchor portion 107, or a slotted tubular, because an expandable tubular 105 which is a slotted tubular is deformed with less radial force than a solid expandable tubular 105. Furthermore, when the expandable tubular 105 is a slotted tubular, the slots in the expandable tubular 105 increase in size to become diamond-shaped (see FIG. 9A). The diamond-shaped slots allow the anchor portion 107 of the expandable tubular 105 to exert more frictional force upon expansion against the inner diameter of the wellbore 10 than the friction exerted by a solid tubular, thus more effectively anchoring the expandable system 100 against the wellbore 10. Perforated tubulars may also be used in the expansion system 100 to function similar to the slotted tubulars (see FIG. 10). The perforations may be round, rectangular, or square in shape, and the rectangular or square perforations may include rounded corners. In the same manner, rubber material may be disposed on the outer diameter of at least the anchor portion 107 of the expandable tubular 105 as shown in FIG. 11 so that the rubber-coated expandable tubular 105, when expanded against the wellbore 10, exerts more frictional force to grippingly engage the inner diameter of the wellbore 10 than the frictional force that a solid tubular exerts. Similarly, the outer diameter of at least the anchor portion 107 may be altered by knurling or roughening as shown in FIG. 12 or by the addition of spikes as shown in FIG. 13 to provide frictional force to grip the wellbore 10. The slots, perforations, knurling, roughening, spikes, or rubber coating allow the anchor portion 107 of the expandable tubular 105 to effectively bite into the formation 30 and create a holding force between the expandable tubular 105 and the wellbore 10.

Figure 9A:
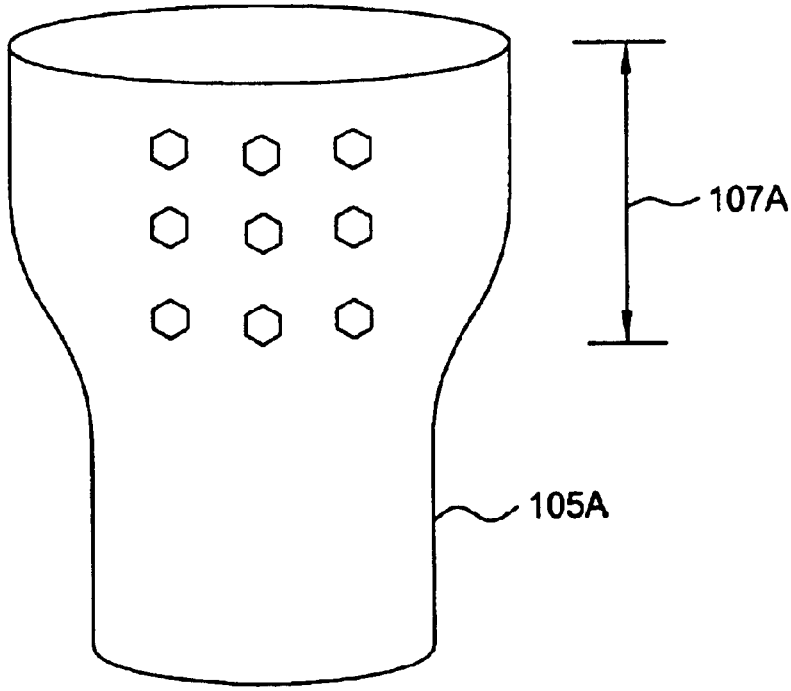
FIG. 9A shows the tubular of FIG. 9 expanded.

Other configurations of the expandable tubular 105 which increase the anchoring power of the-expandable tubular 105 to the wellbore 10 include but are not limited to varying the density of the slots on the expandable tubular 105 along the length of the expandable tubular 105 so that the slots are more dense on the anchor portion 107 of the expandable tubular 105 than on remaining portions to increase friction at the densely-slotted portion of the expandable tubular 105, varying the orientation of the slots in the expandable tubular 105 so that the slots are substantially vertical on one portion of the expandable tubular 105 and substantially horizontal on another portion of the expandable tubular 105, providing slots which are angled between vertical and horizontal, and providing slots on the anchor portion 107 of the expandable tubular 105 and solid tubular on another portion of the expandable tubular 105 as shown in FIGS. 9 and 9A. The shape of the anchor portion 107 of the expandable tubular 105 and its anchoring power can be manipulated according to the needs of the user by altering these characteristics of the expandable tubular 105.

Furthermore, the shape and holding power of the anchor portion 107 of the expandable tubular 105 may be altered by heat treating the expandable tubular 105 prior to its insertion into the wellbore 10. Heat treating can be used to vary the amount of radial force needed to deform the expandable tubular 105 so that the packer 25 may more easily deform the anchor portion 107. For example, if the upper portion of the expandable tubular 105 (along its longitudinal axis) is intended to anchor the expandable system 100 within the wellbore 10, the uppermost portion may be heat treated to deform at 40,000 psi, the next lower portion of the expandable tubular 105 may be heated treated to deform at 50,000 psi, and progressively lower portions of the expandable tubular 105 may be heat treated to deform at progressively higher pressures. The remainder of the expandable tubular 105 which is not used to anchor the expandable system 100 may then require 80,000 psi to deform. In this way, the expandable tubular 105 may bubble outward at the anchor portion 107 to anchor the expandable system 105.

In the alternative, if the lower portion of the expandable tubular 105 is intended to anchor the expandable system 100 within the wellbore 10, the lowermost portion of the expandable tubular 105 may experience heat treatment so that it is easiest to deform, and deformation of the expandable tubular 105 may become progressively more difficult according to varying heat treatments when moving upward along the expandable tubular 105. Then, the remainder of the expandable tubular 105 may require the most force to deform.

Heat treatment of portions of the expandable tubular 105 may be accomplished by supplying heat by means of an induction coil to the desired portions. Alternatively, the heat may be supplied to treat portions of the expandable tubular 105 by heating a mantel located on the expandable tubular 105, thus providing a conductive source of heat to the expandable tubular portion. Any other method known by those skilled in the art of treating tubulars to modify tensile strength or yield strength of the tubulars may be used with the present invention.

The process of heat treating a typical expandable tubular involves first austentizing the tubular. Austentizing is the step of the process in which the tubular is hardened by gradually heating the tubular to above its critical temperature. After the tubular is austentized, the temperature of the heat supplied to the tubular is drastically reduced. At this point, the tubular possesses high strength but exhibits brittleness.

The brittle character of the tubular may cause the tubular to break upon expansion; therefore, the next step in the process is typically tempering the expandable tubular to reduce brittleness. After the tubular is cooled down, it is again heated. This time, the tubular is heated to a temperature below critical temperature. The temperature of the heat supplied to the tubular is gradually reduced. An exemplary expandable tubular at this step in the process may possess a yield strength of about 90,000 psi, a tensile strength of about 110,000 psi, and a percent ductility or percent elongation of about 20%.

According to the heat treatment process of the present invention, a portion (or multiple portions) of the expandable tubular 105 of the present invention may be further heat treated to modify the yield strength, tensile strength, and/or percent elongation of the portion of the expandable tubular 105. A "tempering back" process is performed to soften portions of the expandable tubular. The tempering back process includes a further austentizing process followed by cooling the expandable tubular. After completion of the tempering back process, the exemplary expandable tubular may have a yield strength of about 65,000 to 75,000 psi, a tensile strength of around 90,000 psi, and/or a percent elongation or percent ductility of about 26%. If the cooling of the expandable tubular is slow so that the power of the heat source is decreased rather than turned completely off, which results in a high temperature process with a controlled slow cool, the expandable tubular may be annealed so that it is soft and ductile. An exemplary annealed expandable tubular may have a yield strength of 45,000 to 55,000 psi, a tensile strength of about 75,000 psi, and/or a percent elongation or percent ductility of about 30%. Therefore, the heat treatment process of the present invention decreases the yield strength and tensile strength of the tubular, while increasing the ductility of the tubular. Thus, the portion of the tubular which is heat treated is easier to deform than the portion of the tubular which is not heat treated. Furthermore, varying the amount of heat treatment supplied to a portion of the tubular causes the tubular to deform at predetermined locations on the tubular, such as the anchor portion 107.

The pressure required to deform the expandable tubular 105 and the shape of the expandable tubular 105 may also be manipulated by altering the wall thickness of the expandable tubular 105. The greater the wall thickness, the greater the pressure necessary to deform the expandable tubular 105, and vice versa. The wall of the anchor portion 107 to anchor the expandable system 100 may be predisposed to be thinner than the portion of the expandable tubular 105 which is not intended to anchor the expandable system 100.

In operation, the expandable system 100 is lowered into the wellbore 10 in the run-in position according to FIG. 1. The packer 25 is unactuated. The entire expandable system 100 may be run into the wellbore 10 together on the working string because the deployment system 150 is connected to the expandable tubular 105 by the collet fingers 155 engaged in the groove 95. The sleeve 33 within the collet fingers 155 biases the collet fingers 155 radially outward to allow engagement in the groove 95. Thus, the expandable tubular 105 and the deployment system 150 translate together axially within the wellbore 10.

Figure 2:
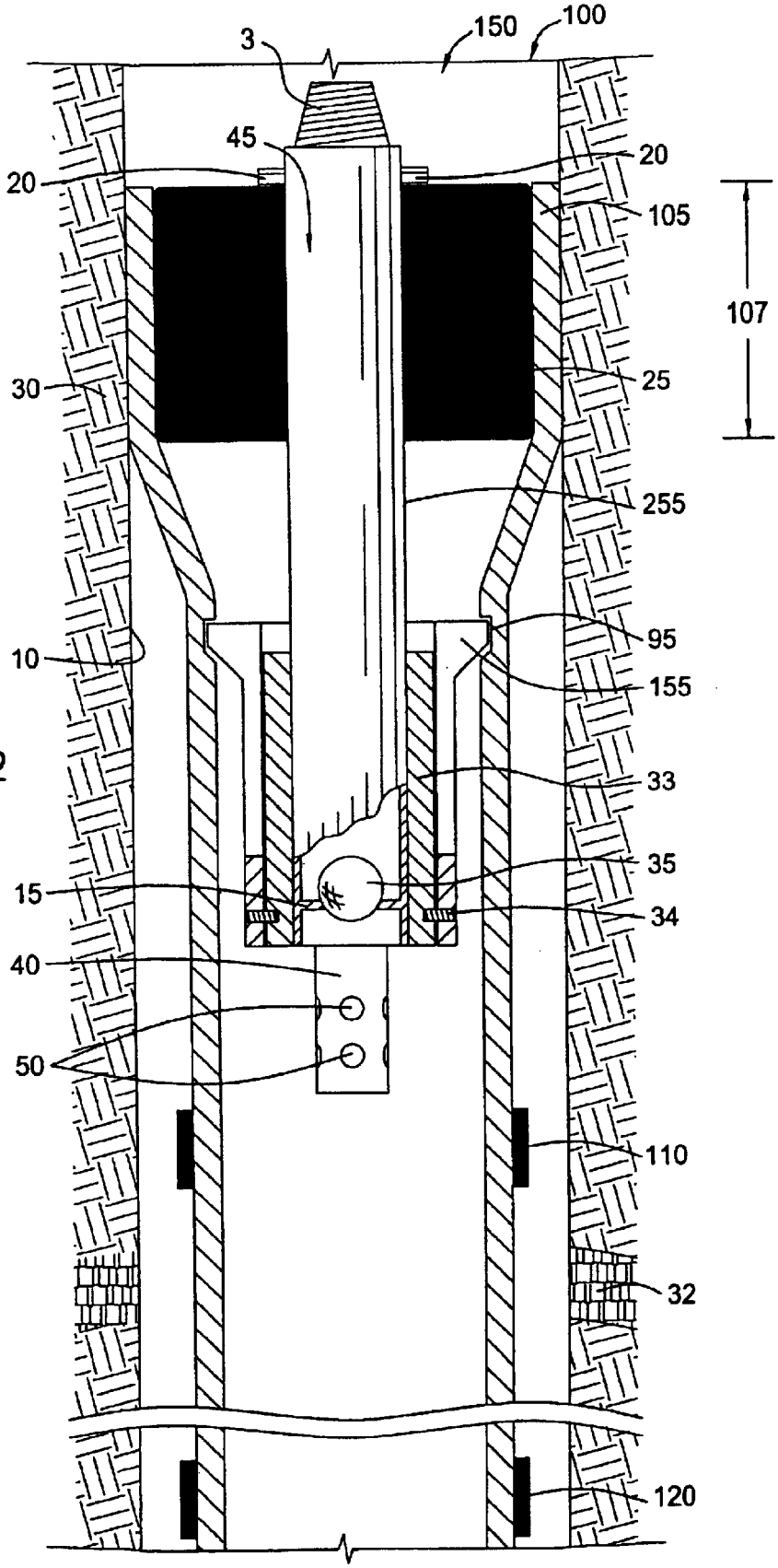
FIG. 2 is a cross-sectional view of the expandable system of FIG. 1, with the packer actuated to expand the expandable tubular into contact with the wellbore.

Once the expandable system 100 is lowered in the wellbore 10 to the desired depth for anchoring the expandable tubular 105 within the wellbore 10, a ball 35 is dropped into the deployment system 150 from the surface, as depicted in FIG. 2. Pressurized fluid 45 is introduced into the deployment system 150 from the surface. Initially, the ball 35 is hindered by the ball retaining assembly 15 from downward movement due to fluid pressure. The ball 35 obstructs fluid flow from the lower end of the deployment system 150 into the wellbore 10, thus creating increasing fluid pressure within the tubular 5. The pressure build-up in the deployment system 150 forces fluid 45 to flow from the inner diameter of the tubular 5, through the valve 20, and into the packer 25. The fluid 45 flowing into the packer 25 inflates the packer 25 so that the packer 25 expands radially to contact the inner diameter of the expandable tubular 105. Increasing inflation pressure of the packer 25 then places pressure on the expandable tubular 105, and the anchor portion 107 of the expandable tubular 105 is deformed into gripping contact with the wellbore 10 by radial force exerted by the packer 25. Frictionally contacting the anchor portion 107 of the expandable tubular 105 with the wellbore 10 anchors the expandable system 100 rotationally and axially relative to the wellbore 10.

Figure 3:
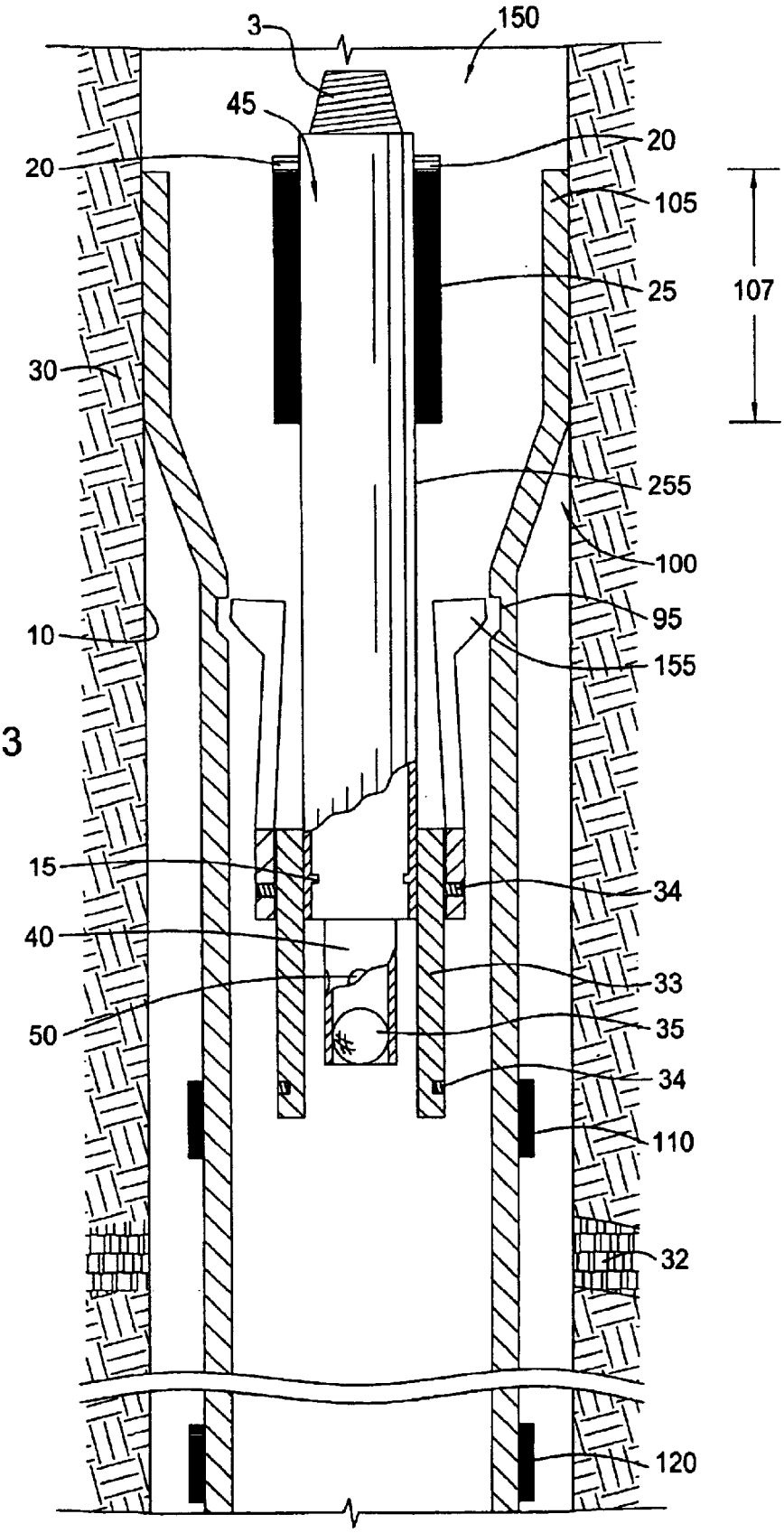
FIG. 3 is a cross-sectional view of the expandable system of FIG. 1, with the packer deflated and the collet collapsed after expansion of the expandable tubular into contact with the wellbore.

FIG. 3 shows the expandable system 100, wherein the anchor portion 107 has been expanded into the wellbore 10 to anchor the expandable system 100. After expansion of the anchor portion 107, pressure is further increased within the deployment system 150 to release the releasable connection 34, which is preferably a shearable connection. Upon release of the releasable connection 34, the sleeve 33 then moves downward relative to the collet fingers 155 so that the collet fingers 155 move inward radially to release the collet fingers 155 from the groove 95. The releasable connection 34 may also be released by upward movement of the sleeve 33 relative to the collet fingers 155, and the releasable connection 34 may also include engaged threads which may be released upon unscrewing.

Next, fluid pressure is further increased within the deployment system 150 so that the ball 35 is forced through the ball retaining assembly 15 and into the ball catcher 40. The holes 50 in the ball catcher 40 permit fluid 45 to flow from the tubular 5 into the wellbore 10, releasing pressure build-up within the deployment system 150. To then deflate the packer 25, the working string is manipulated by either turning, pulling, or pushing from the surface to open the valve 20 and therefore cause fluid to flow from the inside of the packer 25 back into the tubular 5. Decreasing the outer diameter of the packer 25 and collapsing the collet fingers 155 radially inward permits the deployment system 150 to move axially and radially relative to the expandable tubular 105. The deployment system 150 is then retrieved from within the wellbore 10 to the surface. Because of the previous deformation of the anchor portion 107 into gripping engagement with the wellbore by the packer 25, the expandable tubular 105 remains anchored within the wellbore 10 upon retrieval of the deployment system 150.

Figure 4:
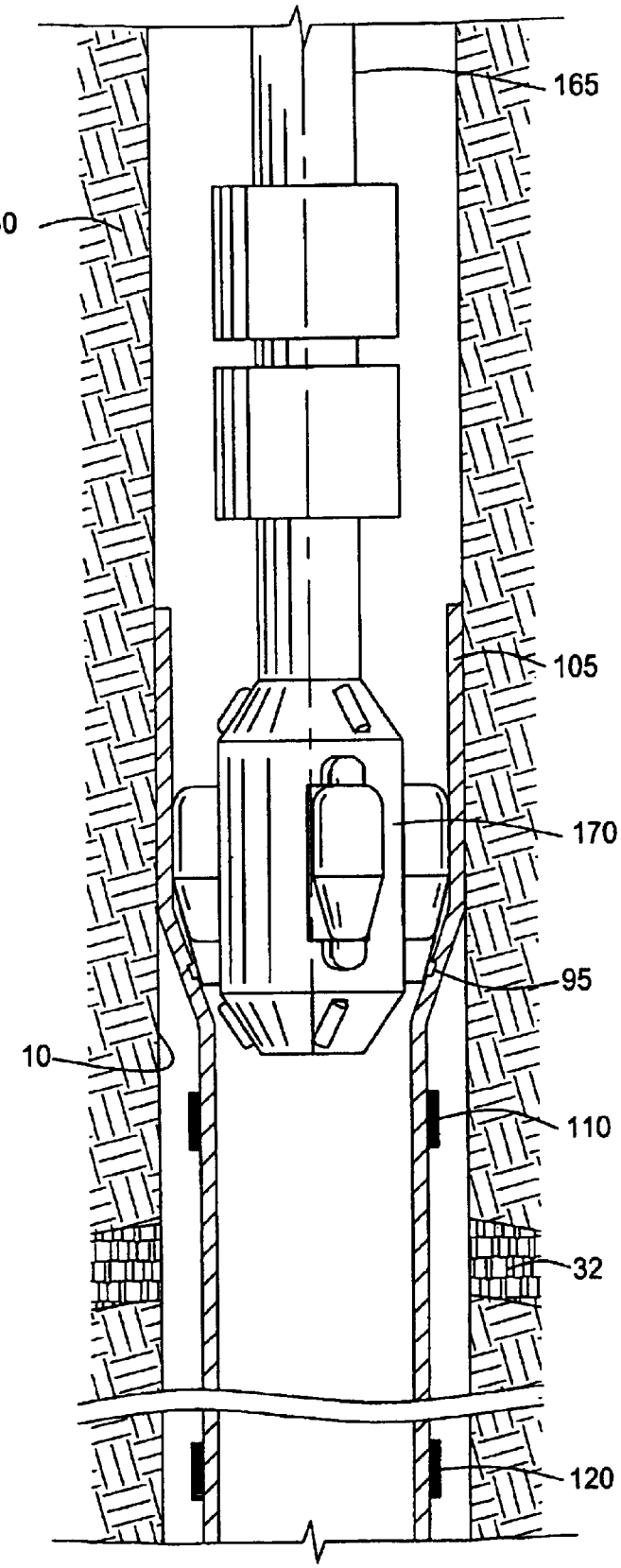
FIG. 4 is a cross-sectional view of the expandable system of FIG. 1, wherein the collet is collapsed, the tubular with the packers attached thereto is retrieved from the wellbore, and a working string with an expander tool thereon is run into the wellbore.

FIG. 4 depicts the expandable tubular 105 anchored within the wellbore 10. After retrieval of the deployment system 150, an expander tool 170 is run into the wellbore 10 on a working string 165. The expander tool 170 may be coupled to a motor (not shown) to impart rotational movement to the expander tool 170. The motor is disposed on the working string 165, and it may be hydraulically actuated by fluid pumped through the working string 165. Although a rotary expander tool is depicted herein for use with the present invention, other types of expander tools such as cone-shaped mandrels are also applicable according to aspects of the present invention. U.S. patent application Ser. No. 10/328,708, which was above incorporated by reference into the present application, describes the operation of an expander tool which may be used in conjunction with the present invention. The expander tool 170 translates downward axially and rotationally to deform the remaining length of the expandable tubular 105 into contact with the wellbore 10. The designated portion of the wellbore 10 is thus contacted by the outer diameter of the expandable tubular 105 along the length of the expandable tubular 105. The upper packer 110 and lower packer 120 are subsequently deployed to contact the open hole portion of the wellbore 10 and further isolate the area of interest in the formation 30.

Upon completion of the expansion operation, the expander tool 170 is retrieved from the wellbore 10 to the surface by the working string 165. The deployment system 160 may also be dismantled after its retrieval to the surface of the wellbore 10 so that the ball 35 may be removed from the deployment system 150. The deployment system 150 may then be reassembled for subsequent use.

Although FIGS. 1–4 show the anchor portion 107 as the upper portion of the expandable tubular 105, in an alternate embodiment (not shown) of the expandable system 100, the anchor portion 107 is a lower portion of the expandable tubular 105. In this embodiment, the collet fingers 155 and sleeve 33 of the deployment system 150 are placed above the packer 25 on the tubular 5. The lower portion of the expandable tubular 105 is deformed by the packer 25 to serve as the anchor for the expandable system 100. The operation of the expandable system 100 is the same as described above with reference to FIGS. 1–4, except that the expander tool 170 expands the expandable tubular 105 from the bottom up along the length of the expandable tubular 105, rather than expanding from the top down. The anchor portion 107 of the expandable tubular 105 may be heat treated and may be slotted, perforated, or any of the other above-described configurations.

Another alternate embodiment of an expandable system 300 of the present invention disposed in a wellbore 210 is depicted in FIGS. 5–8. In this embodiment, the expandable system 300 includes an expandable tubular 305 and a deployment system 350 which are connected by a collet including collet fingers 355 releasably connected by a releasable connection 234, preferably a shearable connection, to a sleeve 233. The sleeve 233 is disposed around a tubular 205 with a longitudinal bore therethrough of the deployment system 350, while the collet fingers 355 are disposed around the sleeve 233. The collet fingers 355 are initially biased radially outward by the sleeve 233 to engage a groove 295 in the expandable tubular 305, just as in the embodiment shown in FIGS. 1–4. Also similar to the embodiment shown in FIGS. 1–4, the deployment system 350 of FIG. 5 comprises a packer 225, preferably an inflatable packer, disposed on the outer diameter of the tubular 205, the sleeve 233 and the collet fingers 355 disposed around the outer diameter of the tubular 205 and located below the packer 225, and a ball retaining assembly 215 located below the collet fingers 355. The expandable tubular 305 has an upper packer 310 and a lower packer 320 disposed therearound, so that the packers 310, 320 may be deployed to isolate an area of interest within the wellbore 210. All of the above parts of the expandable system 300 function as the expandable system 100 of FIGS. 1–4, so descriptions of the parts above apply equally to the parts of FIGS. 5–8.

Unlike the expandable system 100 of FIGS. 1–4, the deployment system 350 of the expandable system 300 of FIG. 5 has a circulating ball sub 290 located below the ball retaining assembly 215 on the tubular 205. A sleeve 260 is disposed in the inner diameter of the circulating ball sub 290. The sleeve 260 has a fluid bypass 265 therearound which allows fluid flow therethrough. Below the circulating ball sub 290 is an expander tool 370, which is connected to the circulating ball sub 290.

Figure 5:
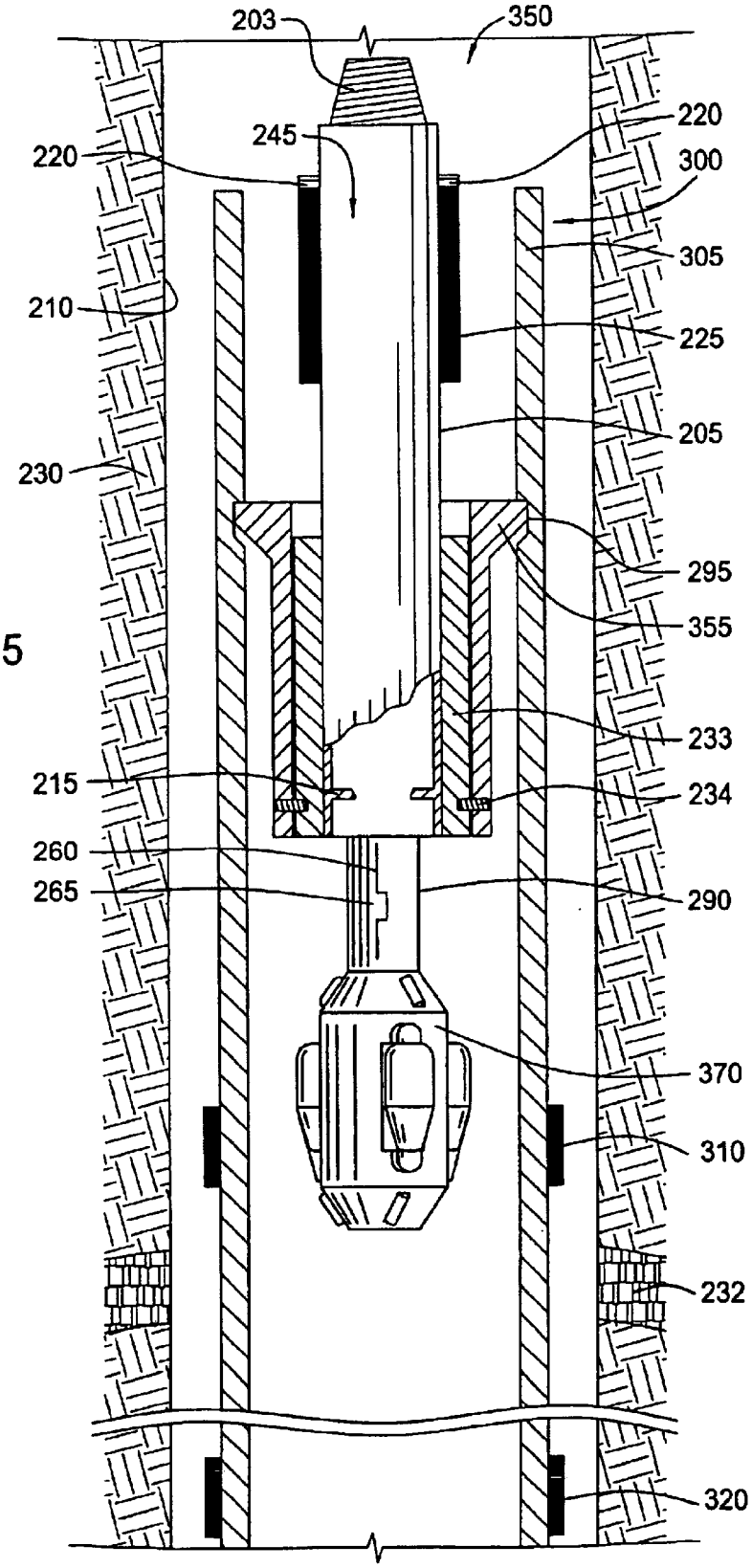
FIG. 5 is a cross-sectional view of an alternate embodiment of the present invention, wherein an expandable system comprises a tubular comprising a packer, a collet, an expander tool, and an expandable tubular. The expandable system is shown in the run-in position.

In operation, the expandable system 300 is run into the wellbore 210 from the surface on the working string (not shown), as shown in FIG. 5. Like the embodiment shown in FIG. 1, the packer 225 is deflated and unactuated in the run-in configuration. The entire expandable system 300 may be run into the wellbore 210 together on the working string because the collet fingers 355 retain the expandable tubular 305 on the deployment system 350. The expandable system 300 is run into the desired depth within the wellbore 210 at which to anchor the expandable tubular 305 for isolation of the area of interest.

Figure 6:
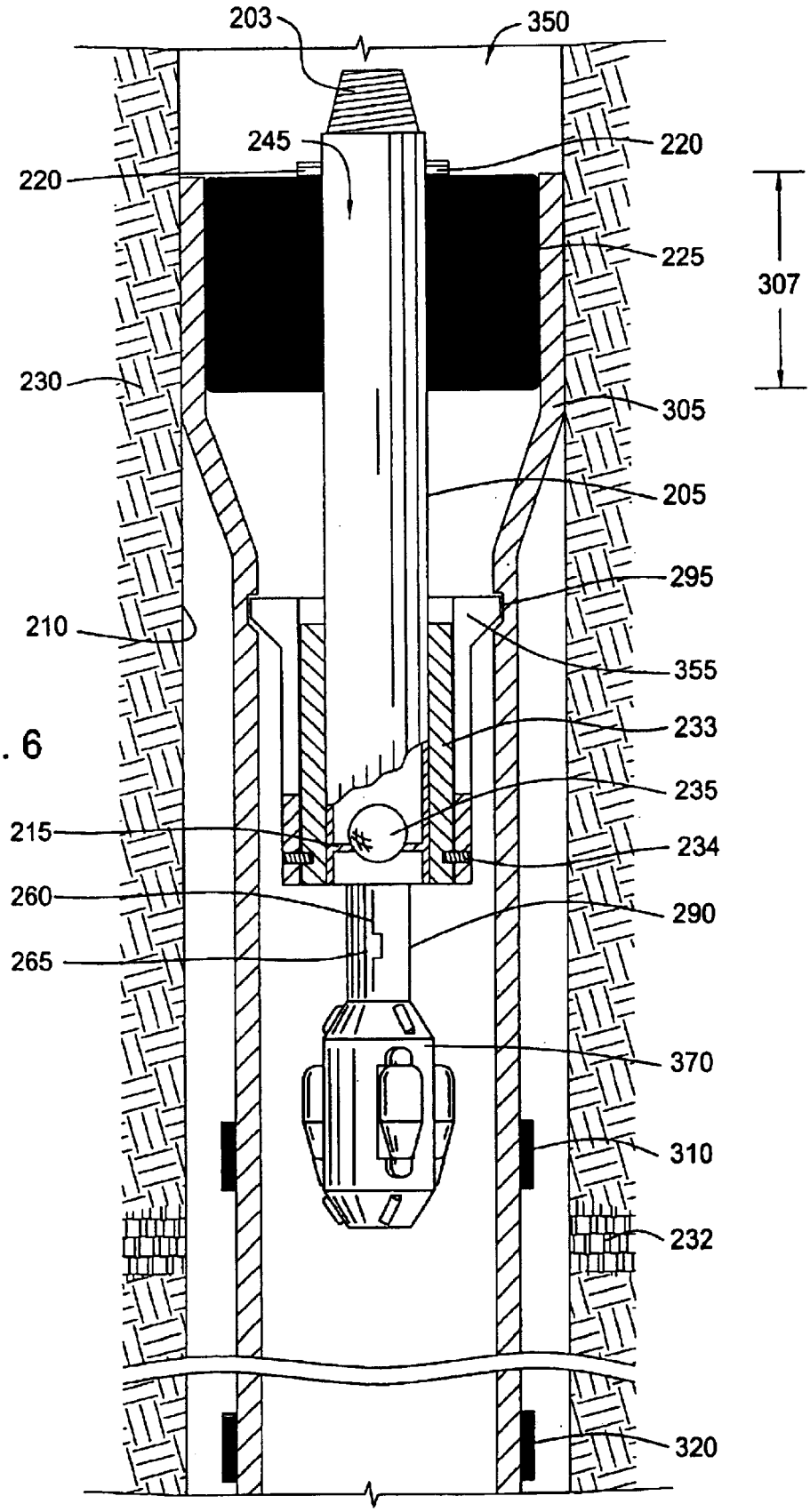
FIG. 6 is a cross-sectional view of the expandable system of FIG. 5, with the packer actuated to expand the expandable tubular into contact with the wellbore.

The next step in the operation is shown in FIG. 6. Just as in the embodiment of FIG. 2, a ball 235 is dropped into the deployment system 350 through the working string. Pressurized fluid 245 is introduced into the deployment system 350 from the surface of the wellbore 210 to inflate the packer 225 as described above with reference to FIG. 2. In this embodiment, fluid 245 is prevented from entering the circulating ball sub 290 and the wellbore 210 by the ball 235, which plugs the opening in the ball retaining assembly 215. The fluid build-up creates sufficient pressure within the deployment system 350 to inflate the packer 225. The packer 225 is inflated in the same way as in FIG. 2 to expand the outer diameter of an anchor portion 307 of the expandable tubular 305 into frictional contact with the inner diameter of the wellbore 210.

After the anchor portion 307 is expanded into contact with the wellbore 210 so that the expandable system 300 is anchored axially and rotationally with respect to the wellbore 210, fluid pressure is increased to release the releasable connection 234 between the sleeve 233 and the collet fingers 355 Because the sleeve 233 no longer biases the collet fingers 355 radially outward, the collet fingers 355 move radially inward so that the collet fingers 355 are no longer engaged in the groove 295.

Figure 7:
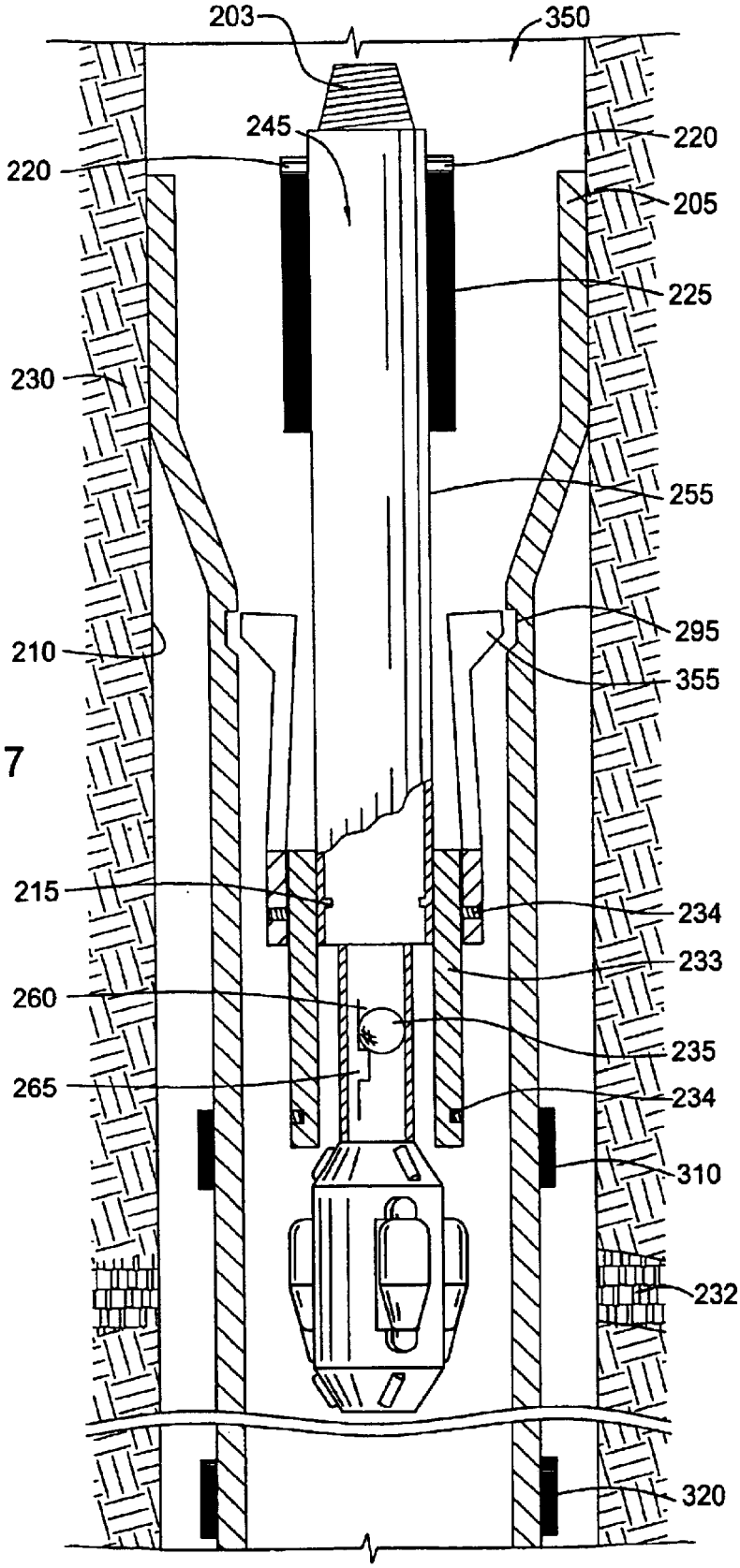
FIG. 7 is a cross-sectional view of the expandable system of FIG. 5, with the packer deflated and the collet collapsed after expansion of a portion of the expandable tubular into contact with the wellbore.

Pressure is then further increased so that the ball 235 is forced into the circulating ball sub 290 as shown in FIG. 7. Although the inner diameter of the circulating ball sub 290 is larger than the outer diameter of the ball 235, the sleeve 260 hinders the ball from dropping through the circulating ball sub 290 and into the expander tool 370. At the same time, the sleeve 260 allows fluid to flow through the circulating ball sub 290 through the fluid bypass 265 while the ball 235 remains within the circulating ball sub 290. Retaining the ball 235 within the circulating ball sub 290 prevents the ball 235 from entering the expander tool 370 so that the operation of the expander tool 370 is not negatively affected by the presence of the ball 235.

The packer 225 is then deflated by turning, pulling, or pushing the working string to open the valve 220, releasing fluid from the packer 225 into the tubular 205 and deflating the packer, as described in relation to FIG. 3. The expandable tubular 305 remains anchored within the wellbore 210 by frictional forces between the anchor portion 307 of the expandable tubular 305 and the wellbore 210. However, because the collet fingers 355 and the packer 225 are contracted, the deployment system 350 is moveable relative to the expandable tubular 305 within the wellbore 210.

Figure 8:
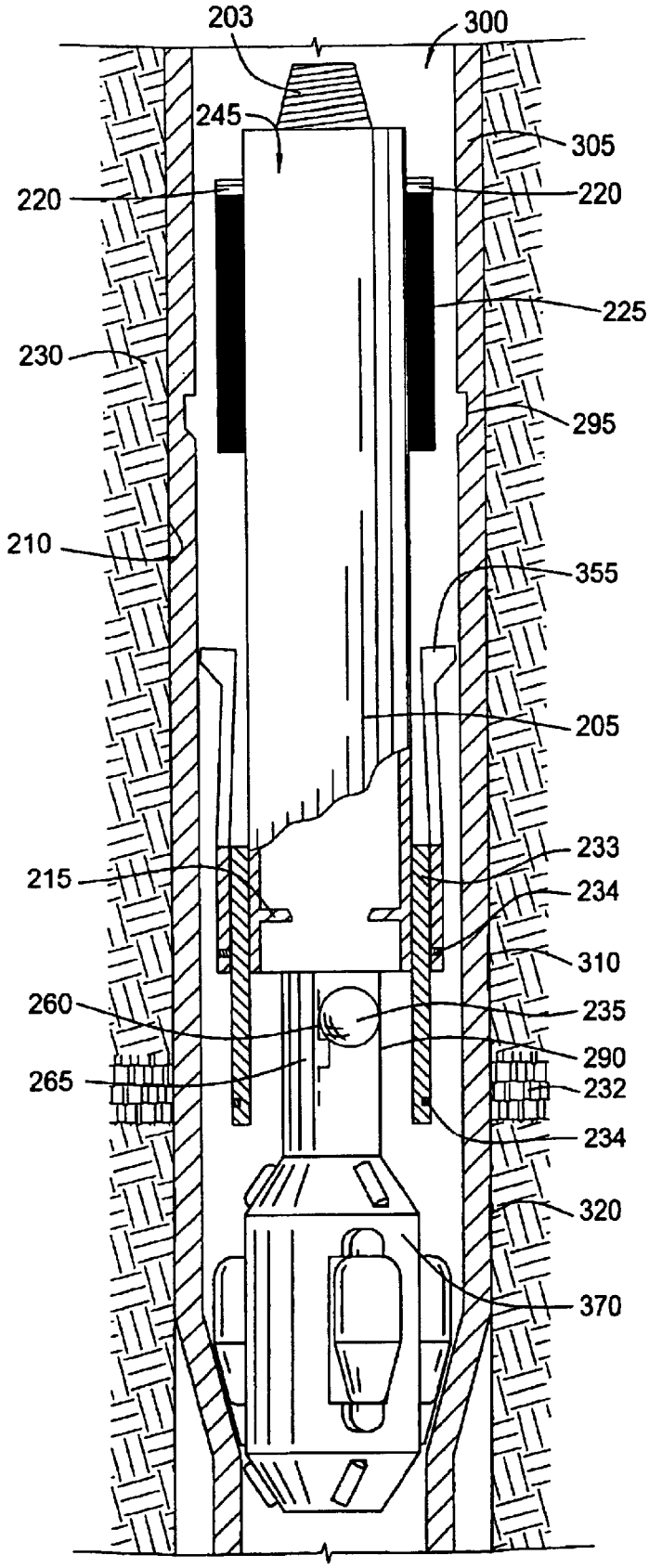
FIG. 8 is a cross-sectional view of the expandable system of FIG. 5, with the collet collapsed. The working string with the expander tool attached thereto is shown expanding the length of the expandable tubular into contact with the wellbore.

As shown in FIG. 8, the expander tool 370 may then translate axially and/or rotationally to expand the remaining length of the expandable tubular 305 into contact with the wellbore 210. The upper packer 310 and the lower packer 320 are then deployed to isolate the area of interest within the wellbore 210. The deployment system 350 is retrieved from the wellbore 210 after the length of the expandable tubular 305 has been expanded into the wellbore 210 and the packers 310 and 320 have been deployed. The ball 235 may then be retrieved from the deployment system 350 by disassembling the deployment system 350 as described above, and the operation of the deployment system 350 may then be repeated.

The embodiment of FIGS. 5–8 advantageously allows expansion of the entire length of the expandable tubular 305 in one run-in of the working string because the expander tool 370 is attached to the same working string as the deployment system 350. The same types and variations of expandable tubulars and packers may be used in the embodiment of FIGS. 5–8 as described with reference to FIGS. 1–4. A particularly preferred expandable tubular 305 for use with the embodiment of FIGS. 5–8 is a combination of slotted and solid tubular. The use of slotted tubular at the anchor portion 307 of the expandable tubular 305 permits sufficient frictional contact to develop between the outer diameter of the expandable tubular 305 and the inner diameter of the wellbore 210 to anchor the expandable system 300 within the wellbore 210 axially and rotationally. At the same time, using solid tubular at the remaining portions of the expandable tubular 305 prevents damage to the expander tool 370 due to beating of the expander tool 370 during its operation with the slots of the slotted tubular and allows the expandable tubular 305 to perform its primary function of isolating the wellbore 210. As discussed above in relation to the embodiment of FIGS. 1–4, the anchor portion 307 in the embodiment of FIGS. 5–8 may be formed on the upper or lower portion of the expandable tubular 305, so that the expander tool 370 expands the remaining portion of the expandable tubular 305 from the top down or from the bottom up. Similarly, the embodiment of FIGS. 5–8 may also be heat treated or rendered of varied wall thickness so that the packer 225 may more easily deform the anchor portion 307 of the expandable tubular 305.

Figure 14:
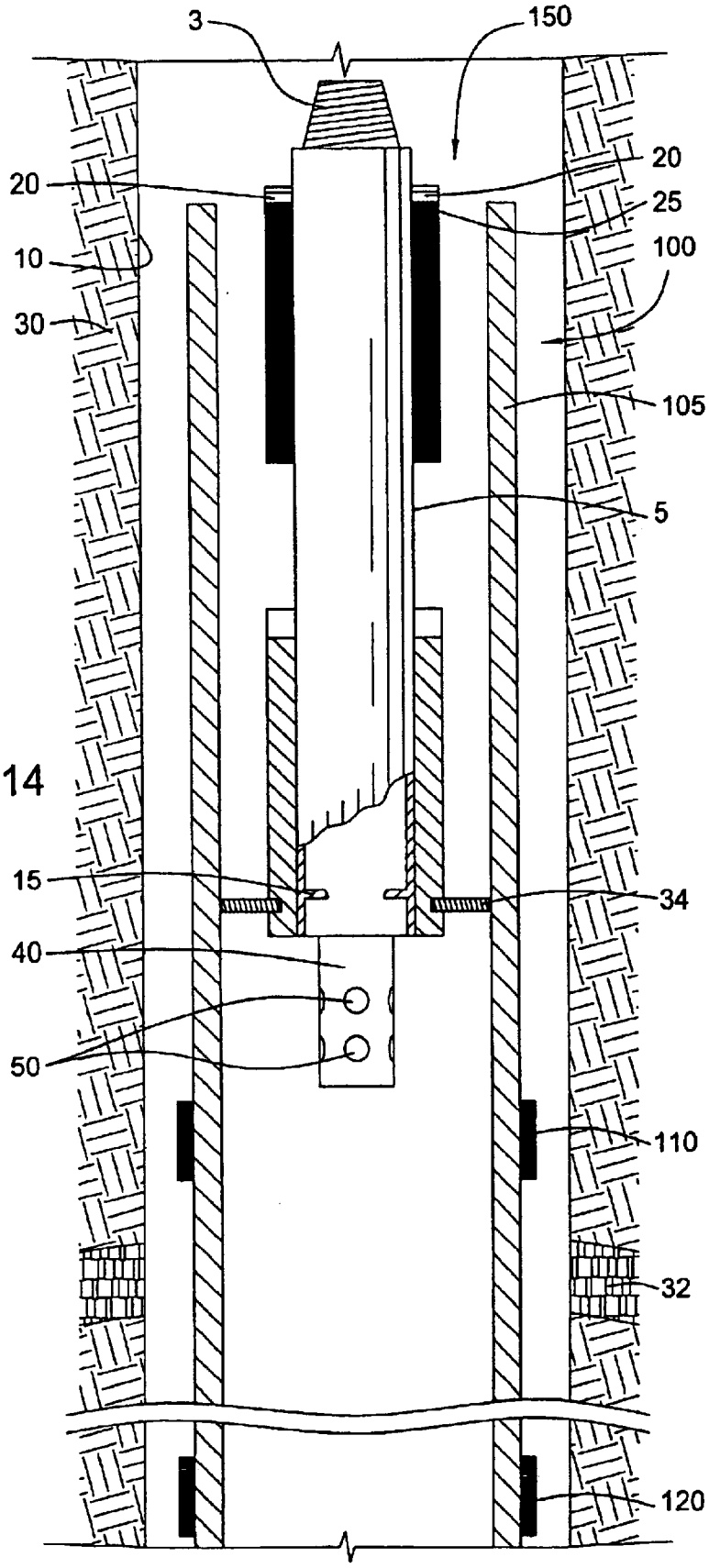
FIG. 14 shows the deployment system of FIG. 1 connected to the expandable tubular with a shearable connection.
Figure 15:
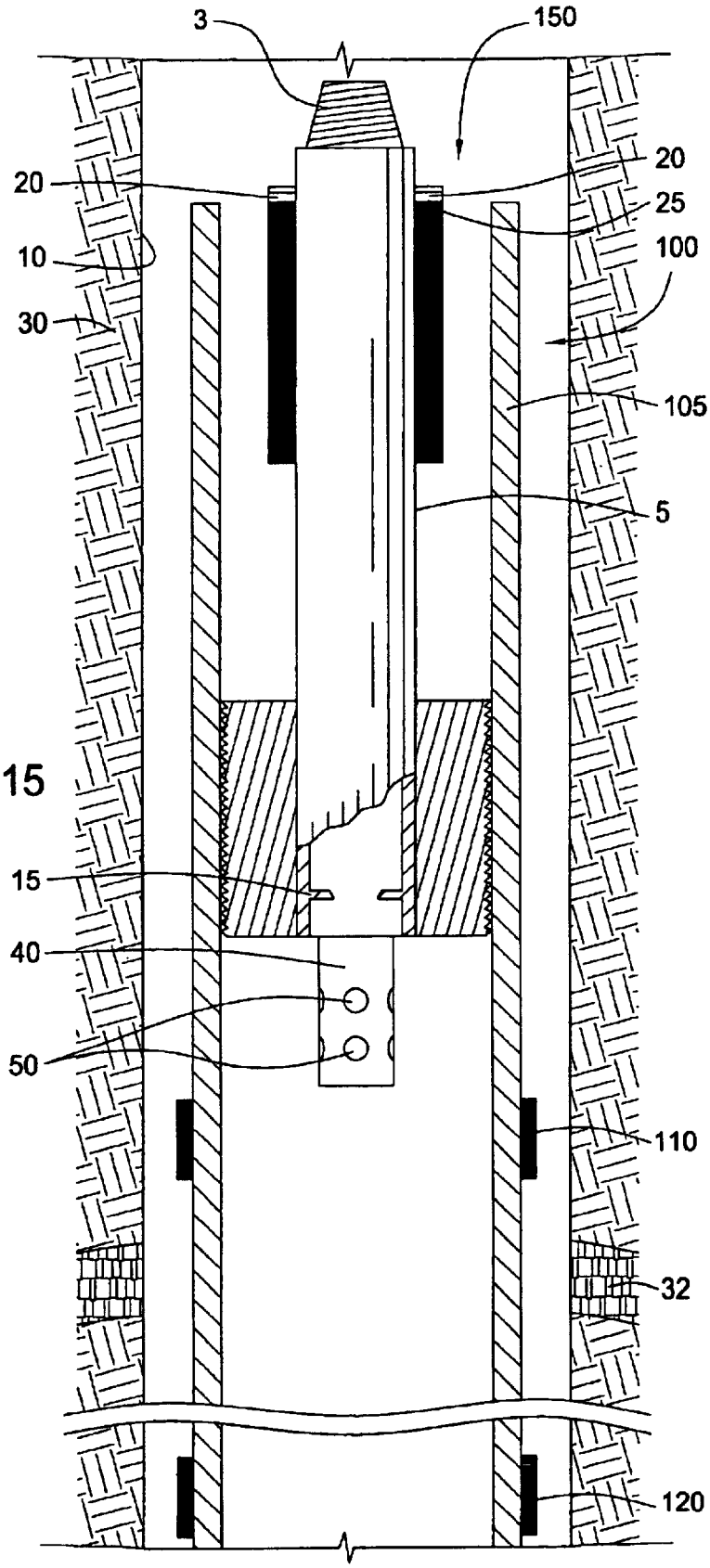
FIG. 15 shows the deployment system of FIG. 1 connected to the expandable tubular with a threadable connection.

In all of the embodiments discussed above, the collet fingers and sleeve may be replaced by a shearable connection (shown in FIG. 14) which is used to temporarily connect the expandable tubular and the deployment system until the anchor is set within the wellbore. Once the expandable tubular is expanded into frictional contact with the wellbore sufficient to anchor the expandable tubular within the wellbore, the connection may be sheared so that the deployment system is moveable axially and rotationally within the wellbore. Similarly, the collet fingers and sleeve may be replaced with a threadable connection between the expandable tubular and deployment system which may be unthreaded after the anchor portion of the expandable tubular has been expanded, as shown in FIG. 15.

While the foregoing is directed to embodiments of the present invention, other and further embodiments of the invention may be devised without departing from the basic thereof, and the scope thereof is determined by the claims that follow.

We claim:

1. An expandable system for anchoring an expandable tubular within a wellbore, comprising:

the expandable tubular;

a deployment system releasably connected to the expandable tubular by a connection member that is releasable by obstruction of a flow path, wherein the deployment system comprises a tubular body and at least one packing element disposed therearound for deforming at least a portion of the expandable tubular into gripping contact with the wellbore; and an expander tool for deforming a remaining portion of the expandable tubular into gripping contact with the wellbore.

2. The expandable system of claim 1, wherein the expandable tubular comprises solid pipe.

3. The expandable system of claim 1, wherein the portion of the expandable tubular comprises slotted pipe.

4. The expandable system of claim 1, wherein the portion of the expandable tubular comprises slotted pipe and the remaining portion of the expandable tubular comprises solid pipe.

5. The expandable system of claim 1, wherein the portion of the expandable tubular comprises perforated pipe.

6. The expandable system of claim 5, wherein the perforated pipe comprises round perforations.

7. The expandable system of claim 5, wherein the perforated pipe comprises rectangular perforations.

8. The expandable system of claim 5, wherein the perforated pipe comprises square perforations.

9. The expandable system of claim 8, wherein the square perforations comprise at least one rounded edge.

10. The expandable system of claim 1, wherein the portion of the expandable tubular comprises perforated pipe and the remaining portion of the expandable tubular comprises solid pipe.

11. The expandable system of claim 1, wherein rubber material is disposed on an outer diameter of the portion of the expandable tubular.

12. The expandable system of claim 1, wherein an outer diameter of the portion of the expandable tubular is altered by knurling.

13. The expandable system of claim 1, wherein spikes are disposed on an outer diameter of the portion of the expandable tubular.

14. The expandable system of claim 1, wherein an outer diameter of the portion of the expandable tubular is roughened.

15. The expandable system of claim 1, wherein the expandable tubular is selectively deformable along its length.

16. The expandable system of claim 1, wherein the at least one packing element is inflatable.

17. The expandable system of claim 1, wherein the expander tool is connected to the deployment system.

18. The expandable system of claim 1, wherein the deployment system is disposed within the expandable tubular.

19. The expandable system of claim 1, wherein the portion of the expandable tubular comprises less tensile strength than the remaining portion of the expandable tubular.

20. The expandable system of claim 1, wherein the expandable tubular is a continuous solid tubular.

21. The expandable system of claim 1, wherein the expandable tubular is disposed on a separate tublar body from the tubular body having the packing element disposed therearound, the separate tubular body located concentrically around the tubular body having the packing element disposed therearound.

22. The expandable system of claim 1, wherein the connection member is releasable by a ball drop.

23. The expandable system of claim 1, wherein the deployment system and the expandable tubular are releasably connected by a connection member.

24. The expandable system of claim 23, wherein the expandable connection member is selectively releasable.

25. The expandable system of claim 23, wherein the connection member is a collet.

26. The expandable system of claim 1, wherein the connection member is selectively shearable.

27. The expandable system of claim 1, wherein the connection member is hydraulically releasable.

28. A method for anchoring an expandable system within a wellbore, comprising:

running the expandable system into the wellbore, the expandable system comprising:

an expandable tubular, and a deployment system, wherein the expandable tubular and the deployment system are releasably connected;

actuating the deployment system to expand radially to contact an inner diameter of the expandable tubular;

expanding at least a portion of the expandable tubular to grippingly engage an inner diameter of the wellbore using the deployment system, wherein the releasable connection is located downhole when expanding the portion of the expandable tubular using the deployment system;

expanding a remaining portion of the expandable tubular into contact with the wellbore using an expander tool; and obstructing a flow path to release the releasable connection before expanding the remaining portion of the expandable tubular.

29. The method of claim 28, wherein actuating the deployment system to contact the inner diameter of the expandable tubular comprises actuating at least one packing element disposed around a tubular body to contact the inner diameter of the expandable tubular.

30. The method of claim 28, further comprising removing the deployment system from the wellbore.

31. The method of claim 28, further comprising running the expander tool into the wellbore prior to expanding the remaining portions of the expandable tubular into contact with the wellbore.

32. The method of claim 31, wherein the portion of the expandable tubular is an upper portion.

33. The method of claim 32, wherein the expander tool expands the remaining portions of the expandable tubular from the upper portion of the expandable tubular to a lower end of the expandable tubular.

34. The method of claim 31, wherein the portion of the expandable tubular is a lower portion.

35. The method of claim 34, wherein the expander tool expands the remaining portion of the expandable tubular from the lower portion of the expandable tubular to an upper end of the expandable tubular.

36. The method of claim 28, wherein the expandable tubular comprises modified tensile strength along its length.

37. The method of claim 28, further comprising reducing the tensile strength of the portion of the expandable tubular which is expanded to grippingly engage the wellbore prior to running the expandable system into the wellbore.

38. The method of claim 37, wherein the tensile strength of the portion of the expandable tubular is reduced by heat treatment.

39. The method of claim 28, further comprising altering the performance characteristics of the portion of the expandable tubular by heat treatment.

40. The method of claim 28, wherein the releaseable connection is located downhole when expanding the portion of the expandable tubular using the deployment system.

41. The method of claim 40, wherein dropping a ball releases the releasable connection before expanding the remaining portio of the expandable tubular.

42. The method of claim 40, further comprising hydraulically releasing the releasable connection before expanding the remaining portion of the expanable tubular.

43. A method for expanding a tubular body into contact with a wellbore, comprising:

running the tubular body with a deployment system releasably connected therein and an expander tool connected to the deployment system into the wellbore, the deployment system comprising at least one packing element disposed around a tubular with a bore therethrough;

actuating the at least one packing element to expand at least a portion of the tubular body into contact with the wellbore to fix the tubular body relative to the wellbore;

dropping a ball to release a releasable connection between the tubular body and the deployment system prior to actuating the expander tool to expand a remaining portion of the tubular body; and actuating the expander tool to expand the remaining portion of the tubular body into contact with the wellbore.

44. The method of claim 43, wherein the expander tool is actuated hydraulically.

45. The method of claim 43, wherein the at least one packing element is inflated by introducing pressurized fluid into the tubular.

46. The method of claim 45, wherein the portion of the tubular body which is expanded by the at least one packing element is heat treated to modify tensile strength prior to running the tubular body into the wellbore.

47. The method of claim 43, further comprising hydraulically releasing the releasable connection between the tubular body and the deployment system prior to actuating the expander tool to expand a remaining portion of the tubular body.

48. The method of claim 43, further comprising de-actuating the packing element prior to actuating the expander tool.

49. The method of claim 43, further comprising moving the deployment system relative to the tubular body when expanding the remaining portion of the tubular body.

50. The method of claim 43, wherein obstructing the flow path includes dropping a ball.

51. An expandable system for anchoring an expandable tubular within a wellbore, comprising:

the expandable tubular; and a deployment system, wherein the deployment system comprises:

a connection member connected to the expandable tubular and releasable from the expandable tubular by obstruction of a flow path;

a tubular body and at least one packing element disposed therearound for deforming at least a portion of the expandable tubular into griping contact with the wellbore; and an expandable tool having radially extending members for deforming a remaining portion of the expandable tubular into gripping contact with the wellbore. hydraulically releasing the releasable connection before expanding the remaining portion of the expandable tubular.

52. An expandable system for anchoring an expandable tubular within a wellbore, comprising:

the expandable tubular;

a deployment system releasably connected to the expandable tubular by a connection member that is releasable by a ball drop, wherein the deployment system comprises a tubular tubular body and at least one packing element disposed therearound for deforming at least a portion of the expandable tubular into gripping contact with the wellbore; and an expander tool for deforming a remaining portion of the expandable tubular into gripping contact with the wellbore.

* * * * *

UNITED STATES PATENT AND TRADEMARK OFFICE

CERTIFICATE OF CORRECTION

PATENT NO. : 7,104,322 B2 
APPLICATION NO. : 10/442690
DATED : September 12, 2006
INVENTOR(S) : Ken Whanger et al.

It is certified that error appears in the above-identified patent and that said Letters Patent is hereby corrected as shown below:

<u>In the Claims section</u>:

In column 13, Claim 26, line 25, after "claim", please delete "1" and insert --23--.

In column 13, Claim 27, line 27, after "claim", please delete "1" and insert --23--.

In column 13, Claim 28, lines 41-44, please delete ", wherein the releasable connection is located downhole when expanding the portion of the expandable tubular using the deployment system".

In column 13, Claim 31, line 60, please delete "portions" and insert --portion--.

In column 14, Claim 43, line 39, please delete "dropping a ball" and insert --obstructing a flow path--.

In column 15, Claim 51, lines 14-17, please delete ", hydraulically releasing the releasable connection before expanding the remaining portion of the expandable tubular".

Signed and Sealed this

Fifteenth Day of May, 2007

JON W. DUDAS
*Director of the United States Patent and Trademark Office*